US006266839B1

(12) United States Patent
Oretti et al.

(10) Patent No.: US 6,266,839 B1
(45) Date of Patent: Jul. 31, 2001

(54) BRUSH

(75) Inventors: John E. Oretti; Kon E. Wong, both of Victoria (AU)

(73) Assignee: E. D. Oates Pty. Ltd., Reservoir (AU)

( * ) Notice: Subject to any disclaimer, the term of this patent is extended or adjusted under 35 U.S.C. 154(b) by 0 days.

(21) Appl. No.: 09/319,540

(22) PCT Filed: Jan. 23, 1998

(86) PCT No.: PCT/AU98/00033

§ 371 Date: Aug. 23, 1999

§ 102(e) Date: Aug. 23, 1999

(87) PCT Pub. No.: WO98/36662

PCT Pub. Date: Aug. 27, 1998

(30) Foreign Application Priority Data

Feb. 19, 1997 (AU) ..... PO5212

(51) Int. Cl.[7] ..... A47L 13/12; A47L 13/52

(52) U.S. Cl. ..... 15/117; 15/111; 15/114; 15/188; 15/257.2

(58) Field of Search ..... 15/106, 111, 114, 15/117, 118, 187, 188, 257.1, 257.2, 257.9, 105

(56) References Cited

U.S. PATENT DOCUMENTS

| | | | | |
|---|---|---|---|---|
| 520,731 | * | 5/1894 | Fisher | 15/106 |
| 2,368,988 | * | 2/1945 | Honart | 15/111 |
| 3,034,168 | * | 5/1962 | Walker | 15/106 |
| 5,060,337 | * | 10/1991 | Van Niekerk | 15/111 |
| 5,313,683 | * | 5/1994 | Dickie | 15/117 |
| 5,966,771 | * | 10/1999 | Stroud | 15/117 |
| 6,000,089 | * | 12/1999 | Renken | 15/118 |

FOREIGN PATENT DOCUMENTS

| | | | | |
|---|---|---|---|---|
| 129828 | * | 1/1929 | (CH) | 15/114 |
| 908074 | * | 8/1945 | (FR) | 15/106 |
| 14086 | * | 6/1909 | (GB) | 15/114 |
| 648 340 | * | 1/1951 | (GB) | 15/106 |

* cited by examiner

*Primary Examiner*—Randall E. Chin
(74) *Attorney, Agent, or Firm*—Nixon & Vanderhye PC; Frank P. Presta

(57) ABSTRACT

A brush including a moulded handle and a support structure formed of a rigid thermoplastic material, the support structure including first and second keying structures provided on opposite sides thereof, the first keying structure having provided thereon a first cleaning element, the second cleaning elements extending in different directions away from the respective keying structures in substantially the same or parallel planes and wherein the first and second keying structures are elongate, having front and rear ends, the front ends being joined together to form an acute angle therebetween and the handle lies in a line which generally bisects the acute angle. There is also provided a combination brush and dustpan, the brush being constructed as described above, the dustpan including a recess which is dimensioned to allow the handle of the brush to be snap fitted into the recess to hold the brush in position.

17 Claims, 4 Drawing Sheets

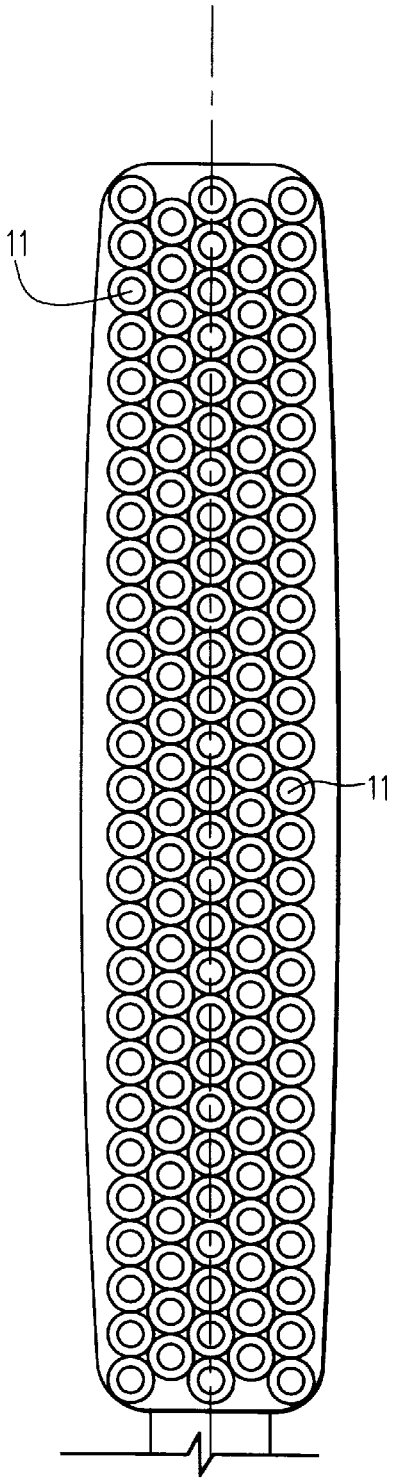
Flg.3
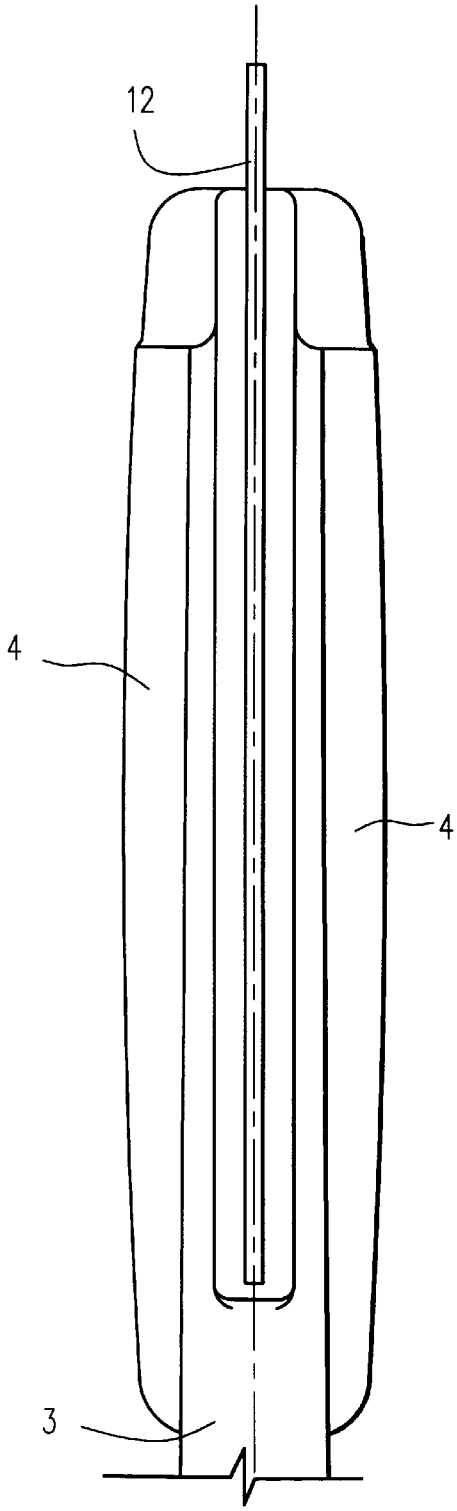
Flg.4

BRUSH

FIELD OF THE INVENTION

This invention relates to brush constructions which incorporate a squeegee blade and bristles and a particular aspect relates to such a brush construction which may be snap fitted to be presented as a combination unit with a dust pan.

BACKGROUND OF THE INVENTION

Brushes and dust pans have been used in house cleaning operations since time immemorial. More recently, with the advent of mouldable plastics material, the handle of the dust pan has included a recess which may be shaped to receive the handle of a brush in a snap fit arrangement in order that the two can be readily stored together.

The advantage of being able to store the two together as a single unit is that the user does not need to go searching for the individual components and there is less likelihood of the two being separated and lost.

Generally speaking, it is preferred that the handle of the brush be constructed in such a way as to ensure that the user does not scrape his or her knuckles against a surface to be brushed. This can be achieved by having a handle which is directed at an angle pointing the brush handle upwards when the brush bristles are in contact with the surface being swept. Alternatively, the handle may be bent so that it is higher than the portion of the brush holding the bristles when the brush is used for sweeping.

Whilst brushes of this type on their own and in combination with dust pans of the aforesaid type are useful and have found common acceptance, they are not necessarily suitable for situations where surfaces requiring cleaning are located in areas such as the laundry or bathroom. As bristles of brushes are unsuitable for brushing away water, the user must use an alternative utensil such as a squeegee blade or mop to clean areas covered with spilled liquid.

In order to reduce the number of utensils required by a user, it would be desirable to provide a brush construction which can perform the sweeping function normally performed by the bristles of a brush and can also be used as a squeegee blade when necessary. Furthermore, it is preferable, that such a utensil, be capable of snap fitting in the handle of a dust pan with the construction of the brush handle being such as to allow the knuckles of a user to be held at a position higher from a surface being brushed or cleaned than the portion of the brush fitted with the bristles or squeegee blade.

DISCLOSURE OF THE INVENTION

In one aspect the invention provides a brush including a moulded handle and a support structure formed of a rigid thermoplastic material, the support structure including first and second keying structures provided on opposed sides thereof, said first keying structure having provided thereon a first cleaning element and said second keying structure having provided thereon a second cleaning element, said first and second cleaning elements extending in different directions away from the respective keying structures in substantially the same or parallel planes.

Suitably the first and second cleaning elements include bristles, blades, spikes or any form of projecting feature which may serve to facilitate cleaning.

Most suitably the first cleaning element includes bristles. Preferably the second cleaning element includes a blade.

The blade may be formed of rubbery thermoplastic material. It may be moulded directly onto the second keying structure.

The bristles are preferably formed of rubbery thermoplastic material. The rubbery thermoplastic material forming the blades and bristles is preferably the same. The bristles are suitably moulded onto the first keying structure. Suitably the rigid thermoplastic material includes polyethylene, polypropylene and/or copolymers of polystyrene and polypropylene. It may include a filler and/or processing additives. The filler may comprise 10% to 40% by weight of the rigid thermoplastic material, more preferably 15% to 25% by weight. Talc is a suitable filler. The processing additives may be chosen to facilitate injection moulding of the thermoplastic material and/or enhancement of the physical characteristics of the rigid thermoplastic material. The rigid thermoplastic material may include a fibrous reinforcement. The fibrous reinforcement may include glass fibre. The fibrous reinforcement suitably comprises 10% to 20% by weight of the rigid thermoplastic material. The rigid thermoplastic material may have a hardness in excess of 70 (as measured in the A scale).

The rubbery thermoplastic material may be chosen from natural or synthetic materials. Preferably it will be chosen from materials which may be injection moulded. It may include a combination of rubber and plastics material. Suitably the rubbery thermoplastic material is a thermoplastic elastomer. It may be rubberised polypropylene. The rubbery material may include additives. The additives may include any one or more of a filler, processing additives, pigment and UV stabiliser. The processing additives may be chosen to enhance the injection moulding characteristics of the rubbery material and/or the physical properties of the material. The filler may be chosen for similar reasons.

The bristles and blade may extend in directions which are obtuse to each other. Suitably the obtuse angle they make with each other falls within the range 110° to 170°, more preferably 145° to 165°.

The support structure may be integrally formed with the handle. It may include an integral attachment region which joins the first and second keying structures to the handle. The keying structures may be elongate, having front and rear ends. They may be generally straight. The front ends may be joined together to form an acute angle therebetween. The rear ends may be joined to the attachment region. The keying structures and attachment region may surround and define an open region. The open region may have a generally quadrilateral or triangular outline. The keying structures and/or attachment region may include an internal extension of reduced thickness.

Suitably the keying structures include features of the construction which act to secure the rubbery thermoplastic material by physical entrapment of the rubbery thermoplastic material. Such features of construction may include recesses, holes, lips, protrusions or overhangs.

Alternatively or additionally, there may be bonding between the rubbery thermoplastic material and the keying structures. Such bonding may be achieved by an adhesive and/or by selection of the materials constituting the rubbery thermoplastic material and the rigid thermoplastic material such that they bond when the two are moulded together.

Suitably the bristles extend in a plurality or rows along the first keying structure. Typically three to seven such rows of bristles can be provided although four to six is generally preferred.

The handle may include a plurality of ribs. The ribs may extend generally perpendicular to the length of the handle. They may encircle the handle.

The brush may be shaped so that it can fit into a moulded plastic dust pan. The handle of the brush may fit into a recess provided in the handle of the dust pan. Most preferably it will be constructed so that it snap fits into the recess to hold the brush in position.

Suitably the shape of the brush is such that the handle may fit into the handle of a dust pan with the remainder of the brush extending into and in registry with the pan portion of the dust pan.

The handle may be arranged to extend at an angle relative to the bristles and/or blade to elevate the handle in use, in order that a user can avoid scraping knuckles of a hand when using either the brush or bristle portion.

The handle may generally extend in the same plane or a plane parallel to the plane or planes in which the blade and bristles extend. The handle may extend in a direction which generally bisects the acute angle.

In an alternative construction both keying structures may include bristles. Suitably the bristles on one keying structure will be softer than the bristles on the other keying structure. The bristles on both keying structures may be moulded directly thereonto. Alternatively, the bristles on one or both of the keying structures may be attached by physically attaching them to holes in the respective keying structure or to holes in a support attached to the keying structure. The holes may be formed in the injection moulding of the keying structure and/or by drilling.

BRIEF DESCRIPTION OF THE DRAWINGS

FIG. 3 illustrates a fragmentary plan view on a larger scale of the bristle portion of the brush of FIG. 1;

FIG. 4 illustrates fragmentary plan view on a larger scale of the blade portion of the brush of FIG. 1;

DETAILED DESCRIPTION OF THE PREFERRED EMBODIMENT

Figure 1:
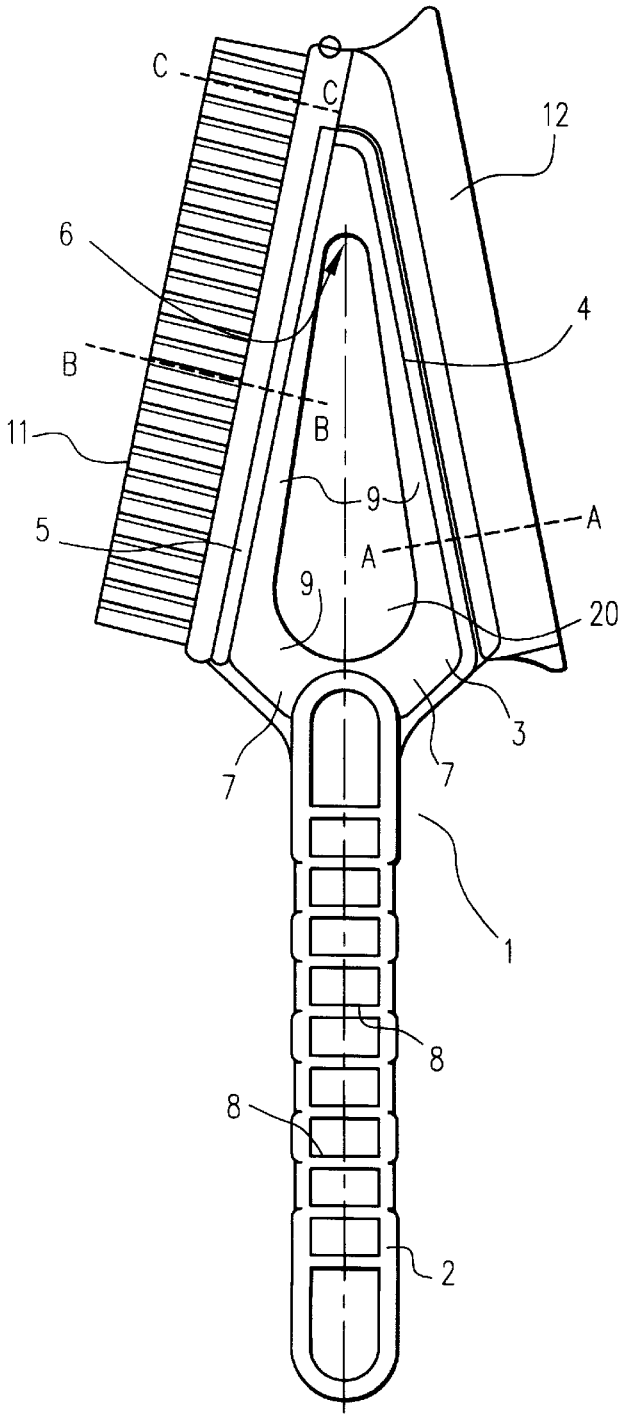
FIG. 1 illustrates an elevational view of a brush constructed in accordance with the invention.
Figure 2:
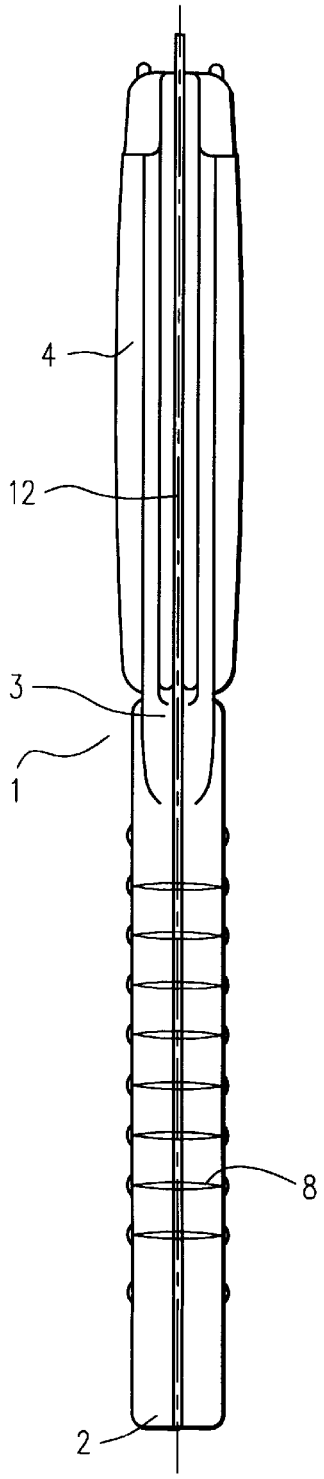
FIG. 2 illustrates a top view of the brush of FIG. 1.
Figure 5:
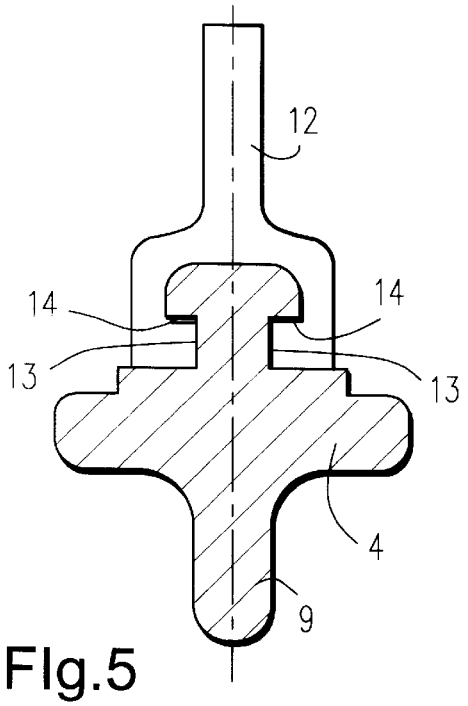
FIG. 5 illustrates the view AA taken through FIG. 1 on a scale of 2:1.

The invention will now be described with reference to the accompanying drawings which illustrate a preferred embodiment of the invention.

Referring to FIGS. 1 to 7 of the accompanying drawings there is shown a brush generally designated 1 which includes a handle 2.

The handle 2 is connected to a support structure 3 provided with the keying structures 4 and 5. The handle 2 and structure 3 are integrally formed of a rigid thermoplastic material which may have been manufactured by injection moulding.

The keying structures 4 and 5 extend generally linearly to form an acute angle 6 at the forward end of the brush.

Ribs 8 or other profile features may be formed on the handle to aid gripping of the handle and also to lend strength.

The keying structures 4 and 5 are joined to the handle via the attachment region 7.

An internal extension 9 of reduced thickness may be formed to improve rigidity and strength of the overall brush support structure. It surrounds an open region 20 of roughly triangular shape.

A plurality of bristles 11 and a blade 12 both formed of the same rubbery thermoplastic material of lesser hardness than the more rigid thermoplastic material of the support structure has been moulded onto the keying structures 4 and 5 in the manner illustrated. The bristles may act as a brush for conventional sweeping and the blade may be used as a squeegee for wet areas.

The keying structures include a number of features of profile such as the channel 13, lips 14 and 15, recesses 16 and protrusion 17 which serve to hold the rubbery thermoplastic material constituting the blade and bristles onto the support structure by physical entrapment when it is moulded on to the keying structures in the manner shown.

Figure 7:
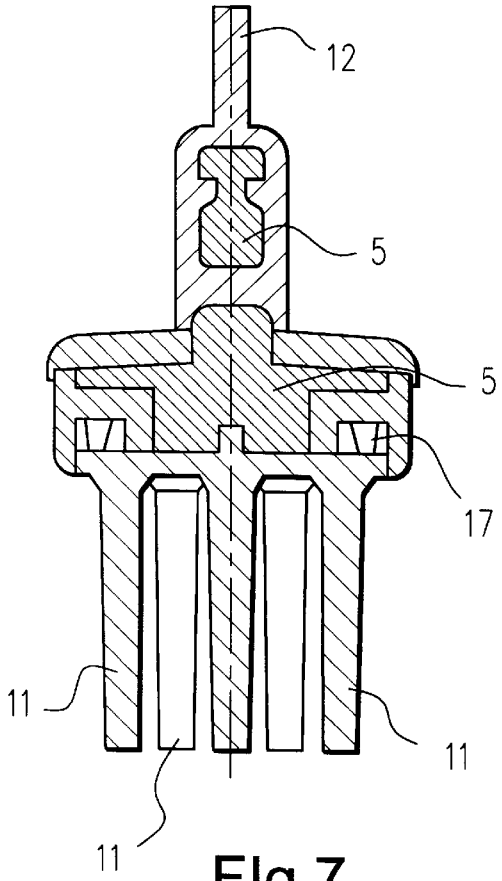
FIG. 7 illustrates the view CC taken through FIG. 1.
Figure 6:
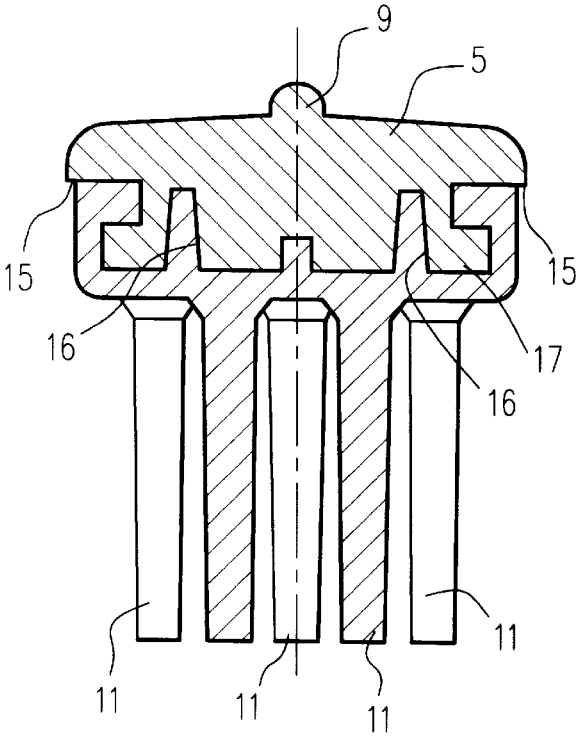
FIG. 6 illustrates the view BB taken through FIG. 1 on a scale of 2:1.

As shown in FIG. 7, the thermoplastic material may be constructed in such a way that the rubbery thermoplastic material may even encircle portions such as the protrusion 17 to ensure a secure connection between the rubbery thermoplastic material and the rigid thermoplastic material of the keying structure.

Figure 8:
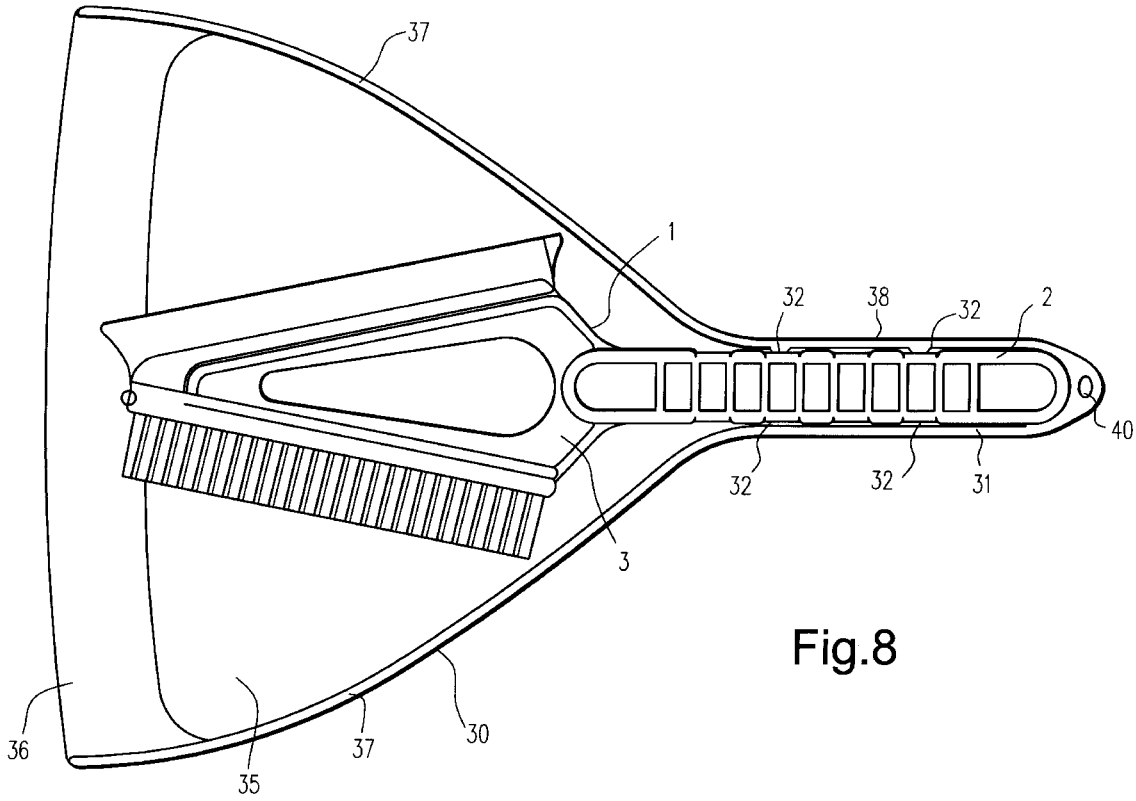
FIG. 8 illustrates a plan view of the brush of FIG. 1 mounted in a dust pan.

Referring to FIG. 8, the brush shown with respect to FIGS. 1 to 7 is mounted in a lay flat configuration in the dust pan 30. A ramp 36 is integrally moulded into the forward edge of the pan.

The bristle/blade structure of the brush 1 extends parallel to and lies within the pan portion 35. The sides 37 of the pan portion 35 extend upwards from the pan portion to a height above the level of the lay flat brush. Similarly the sides of the pan continue to form the sides 38 of the dust pan handle 31 forming a channel which receives the brush handle 2.

A number of ribs 32 are provided on the sides 38 to aid securement of the brush handle within the handle of the pan.

In addition the dimensions of the channel shaped pan handle 31 and brush handle 2 are such that there is sufficient frictional engagement between the two for the brush to remain in place within the dust pan when it is hung via the hole 40 provided at the end of the dust pan handle 31.

Whilst it has been convenient to describe the invention herein in relation to particularly preferred embodiments, it is to be appreciated that other constructions and arrangements are considered as falling within the scope of the invention. Various modifications, alterations, variations and/or additions to the constructions and arrangements described herein are also considered as falling within the scope and ambit of the present invention.

What is claimed is:

1. A brush including a moulded handle and a support structure formed of a rigid thermoplastic material, the support structure including first and second keying structures provided on opposite sides thereof, said first keying structure having provided thereon a first cleaning element and said second keying structure having provided thereon a second cleaning element, said first and second cleaning elements extending in different directions away from the respective keying structures, and wherein the first and second keying structures are elongate, having front and rear ends, the front ends being joined together to form an acute angle therebetween, and the handle lies in a line which generally bisects the acute angle.

2. A brush according to claim 1 wherein the first cleaning element includes bristles and the second cleaning element includes a blade.

3. A brush according to claim 2 wherein the bristles and blade extend in directions which form an obtuse angle therebetween.

4. A brush according to claim 1 wherein the rear ends of the first and second keying structures are joined to the handle by an integral attachment region, the keying structures and attachment region surrounding and defining an open region.

5. A brush according to claim 4 wherein the integral attachment region includes an internal extension of reduced thickness.

6. A combination brush and dustpan, the brush being constructed in accordance with the brush as claimed in claim 1 the dustpan including a recess which is dimensioned to allow the handle of the brush to be snap fitted into the recess to hold the brush in position.

7. A brush according to claim 1 wherein the first and second cleaning elements include a projecting feature which may facilitate cleaning.

8. A brush according to claim 7 wherein the projecting feature is formed of rubbery thermoplastic material.

9. A brush according to claim 8 wherein the projecting feature is formed of rubberized polypropylene.

10. A brush according to claim 8 wherein the keying structures are secured to projecting features formed of rubbery thermoplastic material by keying into a correspondingly shaped recess, hole, lip, protrusion or overhang in the rubbery thermoplastic material.

11. A brush according to claim 1 wherein the keying structures include an internal extension of reduced thickness.

12. A brush according to claim 1 wherein the moulded handle and support structure are an integral unit formed by injection moulding and a rubbery thermoplastic material has been injection moulded onto the first and second keying structures to form the bristles and blade.

13. A brush including a moulded handle and a support structure formed of a rigid thermoplastic material, the support structure including first and second keying structures provided on opposite sides thereof, said first keying structure having provided thereon a first cleaning element and said second keying structure having provided thereon a second cleaning element, said first and second cleaning elements extending in different directions away from the respective keying structures; the first cleaning element including bristles and the second cleaning element including a blade; the blade and bristles being formed of rubbery thermoplastic material.

14. A brush according to claim 13 wherein the rubbery thermoplastic material is rubberised polypropylene.

15. A brush according to claim 13 wherein the moulded handle and support structure are an integral unit formed by injection moulding and the rubbery thermoplastic material has been injection moulded onto the first and second keying structures to form the bristles and blade.

16. A brush according to claim 13 wherein the keying structures are constructed to secure the rubbery thermoplastic material by physical entrapment.

17. A brush according to claim 16 wherein the features of construction include at least one hole, lip, protrusion or overhang.

* * * * *